US008699893B2

(12) United States Patent
Yashiro

(10) Patent No.: US 8,699,893 B2
(45) Date of Patent: Apr. 15, 2014

(54) IMAGE FORMING APPARATUS AND IMAGE FORMING CONTROL METHOD WHICH CALCULATES A REMAINING LIFETIME

(75) Inventor: Akira Yashiro, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 328 days.

(21) Appl. No.: 13/227,860

(22) Filed: Sep. 8, 2011

(65) Prior Publication Data

US 2012/0070161 A1 Mar. 22, 2012

(30) Foreign Application Priority Data

Sep. 16, 2010 (JP) ..... 2010-208205

(51) Int. Cl.
*G03G 15/00* (2006.01)

(52) U.S. Cl.
USPC ..... 399/24

(58) Field of Classification Search
USPC ..... 399/9, 24, 31, 43, 44, 25, 26
See application file for complete search history.

(56) References Cited

U.S. PATENT DOCUMENTS

| | | | | |
|---|---|---|---|---|
| 5,220,389 | A * | 6/1993 | Kishimoto et al. | 399/69 |
| 5,572,306 | A | 11/1996 | Goto et al. | |
| 2006/0034627 | A1 | 2/2006 | Kikuchi et al. | |

FOREIGN PATENT DOCUMENTS

| | | | |
|---|---|---|---|
| JP | 4-178679 | | 6/1992 |
| JP | 2001-22230 | | 1/2001 |
| JP | 2004-45640 | | 2/2004 |
| JP | 2006-30929 | | 2/2006 |
| JP | 2007-226037 | | 9/2007 |
| JP | 2010256823 | A * | 11/2010 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

An image forming apparatus having a fixing part fixing a toner image onto a recording medium by heating it, includes an ambient temperature predicting part predicting an ambient temperature from a fixing temperature rising period of time taken until the fixing part reaches a certain temperature; a member temperature predicting part predicting a member temperature of a member from the predicted ambient temperature and an operating state of the image forming apparatus; a cumulative-used-service-lifetime calculating part calculating a current cumulative used service lifetime from the predicted member temperature, the operating state of the image forming apparatus and an immediately preceding cumulative used service lifetime; a limit-of-usable-period-of-time calculating part calculating a limit of usable period of time by subtracting the calculated current cumulative used service lifetime from a service lifetime of the member; and a reporting part reporting the calculated limit of usable period of time.

11 Claims, 9 Drawing Sheets

FIG.2

T1

| FIXING TEMPERATURE RISING PERIOD OF TIME | 24 SECONDS | 26 SECONDS | 28 SECONDS | 30 SECONDS | 32 SECONDS |
|---|---|---|---|---|---|
| AMBIENT TEMPERATURE | 30°C | 20°C | 10°C | 0°C | −10°C |

FIG.4

T2

| | MEMBER #1 | MEMBER #2 | MEMBER #3 | MEMBER #4 | MEMBER #5 | MEMBER #6 |
|---|---|---|---|---|---|---|
| ON PRINTING (COLOR) | 45°C | 40°C | 32°C | 30°C | 26°C | 31°C |
| ON PRINTING (MONOCHROME) | 45°C | 38°C | 32°C | 30°C | 30°C | 32°C |
| ON WAITING | 40°C | 37°C | 28°C | 26°C | 26°C | 26°C |
| ON SLEEP | 35°C | 25°C | 25°C | 25°C | 25°C | 25°C |

(MEMBER #1 : ALUMINUM ELECTROLYTIC CAPACITOR (ON LOW-VOLTAGE POWER SOURCE, ADDRESS: 101)
MEMBER #2 : ALUMINUM ELECTROLYTIC CAPACITOR (ON LOW-VOLTAGE POWER SOURCE, ADDRESS: 303)
MEMBER #3 : ALUMINUM ELECTROLYTIC CAPACITOR (ON CONTROL SUBSTRATE, ADDRESS: 555)
MEMBER #4 : PHOTOSENSITIVE MEMBER K
MEMBER #5 : PHOTOSENSITIVE MEMBER M, C, Y
MEMBER #6 : INTERMEDIATE TRANSFER BELT)

FIG.5

MEMBER: ALUMINUM ELECTROLYTIC CAPACITOR

| MEMBER TEMPERATURE | −15°C | −10°C | −5°C | 0°C | 5°C | 10°C | 15°C | 20°C | 25°C | 30°C | 35°C | 40°C | 45°C | 50°C | 55°C | 60°C |
|---|---|---|---|---|---|---|---|---|---|---|---|---|---|---|---|---|
| TEMPERATURE COEFFICIENT | 0.063 | 0.094 | 0.125 | 0.188 | 0.250 | 0.375 | 0.500 | 0.750 | 1.000 | 1.500 | 2.000 | 2.500 | 4.000 | 4.500 | 6.000 | 6.500 |

MEMBER: PHOTOSENSITIVE MEMBER

| MEMBER TEMPERATURE | −15°C | −10°C | −5°C | 0°C | 5°C | 10°C | 15°C | 20°C | 25°C | 30°C | 35°C | 40°C | 45°C | 50°C | 55°C | 60°C |
|---|---|---|---|---|---|---|---|---|---|---|---|---|---|---|---|---|
| TEMPERATURE COEFFICIENT | 0.250 | 0.300 | 0.375 | 0.438 | 0.500 | 0.625 | 0.750 | 0.875 | 1.000 | 1.250 | 1.500 | 1.750 | 2.000 | 2.000 | 2.000 | 2.000 |

MEMBER: INTERMEDIATE TRANSFER BELT

| MEMBER TEMPERATURE | −15°C | −10°C | −5°C | 0°C | 5°C | 10°C | 15°C | 20°C | 25°C | 30°C | 35°C | 40°C | 45°C | 50°C | 55°C | 60°C |
|---|---|---|---|---|---|---|---|---|---|---|---|---|---|---|---|---|
| TEMPERATURE COEFFICIENT | 0.600 | 0.600 | 0.600 | 0.600 | 0.600 | 0.700 | 0.800 | 0.900 | 1.000 | 1.100 | 1.200 | 1.300 | 1.400 | 1.500 | 1.600 | 1.700 |

T3

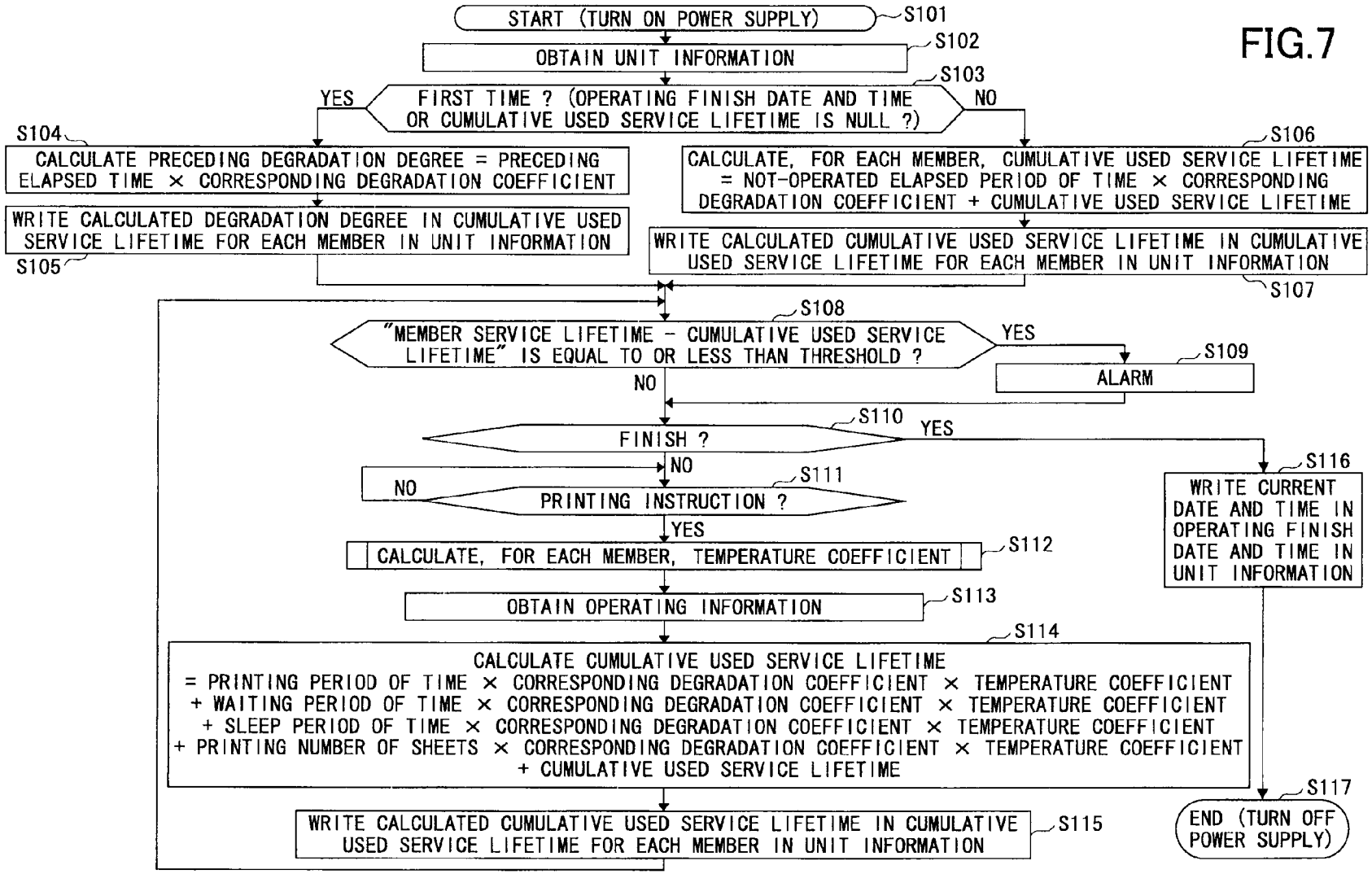
FIG.7
S101
START (TURN ON POWER SUPPLY)
S102
OBTAIN UNIT INFORMATION
S103
FIRST TIME ? (OPERATING FINISH DATE AND TIME OR CUMULATIVE USED SERVICE LIFETIME IS NULL ?)
YES
NO
S104
CALCULATE PRECEDING DEGRADATION DEGREE = PRECEDING ELAPSED TIME × CORRESPONDING DEGRADATION COEFFICIENT
S105
WRITE CALCULATED DEGRADATION DEGREE IN CUMULATIVE USED SERVICE LIFETIME FOR EACH MEMBER IN UNIT INFORMATION
S106
CALCULATE, FOR EACH MEMBER, CUMULATIVE USED SERVICE LIFETIME = NOT-OPERATED ELAPSED PERIOD OF TIME × CORRESPONDING DEGRADATION COEFFICIENT + CUMULATIVE USED SERVICE LIFETIME
S107
WRITE CALCULATED CUMULATIVE USED SERVICE LIFETIME IN CUMULATIVE USED SERVICE LIFETIME FOR EACH MEMBER IN UNIT INFORMATION
S108
"MEMBER SERVICE LIFETIME - CUMULATIVE USED SERVICE LIFETIME" IS EQUAL TO OR LESS THAN THRESHOLD ?
YES
NO
S109
ALARM
S110
FINISH ?
YES
NO
S111
PRINTING INSTRUCTION ?
NO
YES
S112
CALCULATE, FOR EACH MEMBER, TEMPERATURE COEFFICIENT
S113
OBTAIN OPERATING INFORMATION
S114
CALCULATE CUMULATIVE USED SERVICE LIFETIME
= PRINTING PERIOD OF TIME × CORRESPONDING DEGRADATION COEFFICIENT × TEMPERATURE COEFFICIENT
+ WAITING PERIOD OF TIME × CORRESPONDING DEGRADATION COEFFICIENT × TEMPERATURE COEFFICIENT
+ SLEEP PERIOD OF TIME × CORRESPONDING DEGRADATION COEFFICIENT × TEMPERATURE COEFFICIENT
+ PRINTING NUMBER OF SHEETS × CORRESPONDING DEGRADATION COEFFICIENT × TEMPERATURE COEFFICIENT
+ CUMULATIVE USED SERVICE LIFETIME
S115
WRITE CALCULATED CUMULATIVE USED SERVICE LIFETIME IN CUMULATIVE USED SERVICE LIFETIME FOR EACH MEMBER IN UNIT INFORMATION
S116
WRITE CURRENT DATE AND TIME IN OPERATING FINISH DATE AND TIME IN UNIT INFORMATION
S117
END (TURN OFF POWER SUPPLY)

IMAGE FORMING APPARATUS AND IMAGE FORMING CONTROL METHOD WHICH CALCULATES A REMAINING LIFETIME

BACKGROUND OF THE INVENTION

1. Field of the Invention

The present invention relates to a technique for managing a service lifetime of a member or a unit mounted in an image forming apparatus.

2. Description of the Related Art

In the related art, a configuration is known where a non-volatile memory is provided to a toner cartridge or a process cartridge as a detachable image forming unit, and service lifetime information such as guarantee information and/or operating information of the cartridge is stored in the non-volatile memory (see Japanese Laid-Open Patent Application No. 2001-22230 (Patent Document 1) and Japanese Laid-Open Patent Application No. 2006-30929 (Patent Document 2)).

According to Patent Document 1, the guarantee information of the process cartridge converted into the number of rotations of a photosensitive member, the number of times of recording operations of a transfer member or the number of pixels is stored in the non-volatile memory. Then, the guarantee information of the process cartridge is compared with the actual one of the number of rotations of the photosensitive member, the number of times of recording operations of the transfer member or the number of pixels. Then, from the comparison result, the service lifetime of the process cartridge is determined, and the user is notified to replace the process cartridge.

Further, according to Patent Document 1, for particular replaceable parts or devices (hereinafter, referred to as replacement members) included in the process cartridge, the guarantee information of each replacement member prescribed as the number of times of replacement of the photosensitive member (information of the maximum number of times of recycling) or such is stored in the non-volatile memory. Then, the guarantee information of the replacement member is read from the non-volatile memory when it is determined whether the process cartridge is to be recycled. Then, the part having reached the service lifetime is replaced.

According to Patent Document 2, non-volatile storing means is provided to a frame in which replaceable parts and/or devices are held, and service lifetime information of the individual ones of the replaceable parts and/or devices is stored in the non-volatile storing means. Thereby, it is possible to determine whether there are parts/devices, service lifetimes of which have been expired, from the service lifetime information of the individual ones of the replaceable parts and/or devices in the frame. Thus it is possible to easily carry out the replacement work.

Further, according to Patent Document 2, the replaceable parts and/or devices in an image forming unit are configured to be individually removable from the frame. Therefore, it is possible to remove from the frame and replace only parts/devices for which service lifetimes have been expired.

It is noted that a degree of degradation of a member that is degraded due to aging is different depending on an operating environment of the member, and there are many members for which degrees of degradation are different depending on operating temperatures. Therefore, the degree of degradation used for determining the service lifetime from operating information is to be one assuming that the operating environment is the upper limit (i.e., the worst end) of the operating guarantee range. Therefore, there may be a case where even when a service life actually remains for being able to be further used, the member is replaced when it is determined whether it is to be reused.

Generally speaking, a service lifetime of a member is doubled when an ambient temperature is reduced by 10° C. (according to the Arrhenius theorem). For example, assuming that the upper limit of the operating guarantee range is 35° C., in a case where a member having "limit of usable period of time=5 years in 35° C. environment (the upper limit of the operating guarantee range)" has been used as "actual condition=5 years in 25° C. environment", the member can be used for a further 5 years in 25° C. environment. Notwithstanding, it would normally be determined that the member's usable period of time has expired since the determination would be made assuming the upper limit of the operating guarantee range of 35° C. On the contrary, in a case where the member having "limit of usable period of time=operating for 5 years in 35° C. environment (the upper limit of the operating guarantee range)" has been used under "actual condition=operating for 5 years in 45° C. environment", the member will be continuously used notwithstanding the limit of usable period of time actually having already expired after the elapse of 2.5 years. As a result of the member being thus continuously used for which the limit of usable period of time has been already expired as mentioned above, an image being formed in the image forming apparatus may be degraded, or another member or a device may be degraded.

According to Japanese Laid-Open Patent Application No. 2004-45640 (Patent Document 3), the temperature of a printed circuit board on which electric components are mounted is measured, a degree of degradation is obtained from the measured operating temperature, and by using the degree of degradation, the remaining service lifetimes of the electric components are predicted. Therefore, it is possible to precisely know the remaining service lifetimes of the electric components mounted on the printed circuit board, and it is possible to avoid unnecessary replacement otherwise occurring when it is determined whether the components are to be further used.

Further, according to Patent Document 3, the ambient temperature of a target component is predicted from a temperature measurement result of another component, and thus, it is possible to reduce the number of temperature detecting devices.

However, according to Patent Document 3, the temperature detecting devices may be provided only for the purpose of determining the remaining service lifetimes. Thereby, a cost increase may occur.

Further, according to Patent Document 3, a member other than those mounted on the printed circuit board, for example, a photosensitive member, is not considered. Therefore, in a case where the image forming apparatus is, for example, a reuse apparatus (i.e., an apparatus having been collected from the market then being reused after maintenance) or the image forming apparatus includes a reuse cartridge, the past operating environment of the photosensitive member or such of the reuse apparatus or the reuse cartridge is unknown. Therefore, any member which is degraded due to aging should be replaced when it is determined whether the member is to be reused. Therefore, notwithstanding it being not necessary to replace a member (because the member still has a sufficient service lifetime) according to the actual operating environment, the member will be replaced because the actual operating environment thereof is unknown.

Further, Patent Document 3 may not contribute to "Reduction" of preventing a member having been collected from the market and still having a service lifetime from being replaced or dumped as waste.

SUMMARY OF THE INVENTION

According to an embodiment of the present invention, an image forming apparatus having a fixing part that fixes a toner image onto a recording medium by heating it, includes an ambient temperature predicting part configured to predict an ambient temperature from a fixing temperature rising period of time that is a period of time taken until the fixing part reaches a certain temperature; a member temperature predicting part configured to predict a member temperature of a member from the predicted ambient temperature and an operating state of the image forming apparatus; a cumulative-used-service-lifetime calculating part configured to calculate a current cumulative used service lifetime from the predicted member temperature, the operating state of the image forming apparatus and an immediately preceding cumulative used service lifetime; a limit-of-usable-period-of-time calculating part configured to calculate a limit of usable period of time by subtracting the calculated current cumulative used service lifetime from a service lifetime of the member; and a reporting part configured to report the calculated limit of usable period of time.

According to another aspect of the embodiment of the present invention, a method of controlling an image forming apparatus having a fixing part that fixes a toner image onto a recording medium by heating it, includes predicting an ambient temperature from a fixing temperature rising period of time that is a period of time taken until the fixing part reaches a certain temperature; predicting a member temperature of a member from the predicted ambient temperature and an operating state of the image forming apparatus; calculating a current cumulative used service lifetime from the predicted member temperature, the operating state of the image forming apparatus and an immediately preceding cumulative used service lifetime; calculating a limit of usable period of time by subtracting the calculated current cumulative used service lifetime from a service lifetime of the member; and reporting the calculated limit of usable period of time.

It is noted that according to the embodiment of the present invention, the term "ambient temperature" means the ambient temperature of the image forming apparatus.

Other objects, features and advantages of the present invention will become more apparent from the following detailed description when read in conjunction with the accompanying drawings.

BRIEF DESCRIPTION OF THE DRAWINGS

FIG. 2 shows one example of a data structure of an ambient temperature obtaining table;

FIG. 4 shows one example of a data structure of an at-reference-ambient-temperature member temperature obtaining table;

FIG. 5 shows one example of a data structure of a member temperature coefficient obtaining table;

FIG. 7 shows a flowchart of one example of processes for a case where unit information is used;

DETAILED DESCRIPTION OF THE EMBODIMENT

An embodiment of the present invention will now be described.

The embodiment of the present invention has been devised in consideration of the above-mentioned problems in the related arts, and an object of the embodiment of the present invention is to provide an image forming apparatus by which no dedicated part for measuring a temperature is needed, a member for which a temperature is to be known is not limited, a precise degree of degradation considering an operating environment is reported, and thus it is possible to contribute to Reduction, Reuse and Recycle.

<Configuration>

Figure 1:
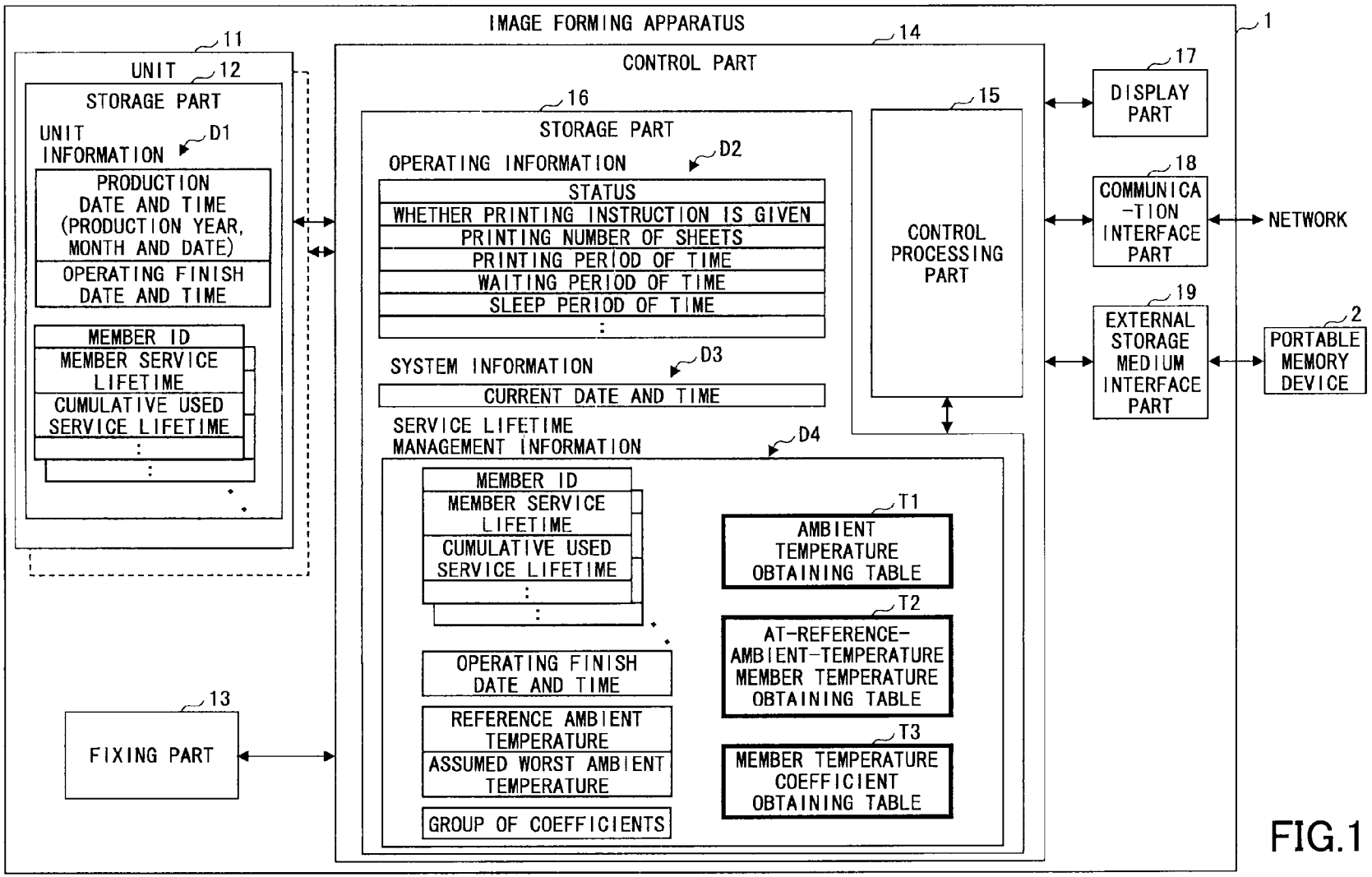
FIG. 1 shows an example of a configuration of an image forming apparatus according to one embodiment of the present invention.

FIG. 1 shows an example of a configuration of an image forming apparatus according to the embodiment of the present invention.

As shown in FIG. 1, the image forming apparatus 1 includes a unit 11, a fixing part 13, a control part 14, a display part 17, a communication interface part 18 and an external recording medium interface part 19.

The unit 11 is a part such as a toner cartridge or a process cartridge which is easily replaced, and includes in the inside a storage part 12 made of, for example, a non-volatile memory. In one case, the single unit 11 exists, and in another case, the plural units 11 exist, in the image forming apparatus 1. The storage part 12 stores, as unit information D1, a production date and time (production year, month and date) and an operating finish date and time, both being common for the unit 11; and member IDs, member service lifetimes, cumulative used service lifetimes and so forth for respective ones of members included in the unit 11. The production date and time (production year, month and date) are date and time (year, month and date) at which the unit 11 is produced. The operating finish date and time are date and time at which usage or operation of the unit 11 most recently finished. The member ID is information used for identifying each member included in the unit 11. The member service lifetime is a value of a service lifetime for which the member can be used. The cumulative used service lifetime is a value of a service lifetime resulting from being consumed due to usage or operation of the member. It is noted that instead of calculating and storing the cumulative used service lifetime each time the member is used or operated, combinations of the temperatures and the operating periods of time at the temperatures may be stored, and after that, the cumulative used service lifetime may be calculated as it is needed.

The fixing part 13 is a part that heats a recording medium (paper) onto which a toner image has been transferred, and fixes the toner image onto the recording medium. A heater (not shown) and a temperature sensor (not shown) which controls a fixing temperature at a certain value (target temperature) are provided to the fixing part 13.

The control part 14 controls operations of the image forming apparatus 1 and includes a control processing part 15 including a CPU (Central Processing Unit) and a storage part 16 that includes a non-volatile memory (not shown), a HDD (Hard Disk Drive, not shown) and so forth. The storage part 16 stores operating information D2, system information D3 and service lifetime management information D4.

The operating information D2 includes a status, "whether printing instruction is given", the printing number of sheets, a printing period of time, a waiting period of time, a sleep period of time and so forth. The status is information indicating a state of the image forming apparatus 1 such as "on printing (color)", "on printing (monochrome)", "on waiting" or "on sleep". The "whether printing instruction is given" is information indicating whether a printing instruction for printing has come. The printing number of sheets is the number of sheets of paper used for the printing. The printing period of time is a period of time required for the printing. The waiting time is a period of time in which neither printing nor entering a sleep mode is carried out. The sleep period of time is a period of time in which the image forming apparatus is in the sleep mode.

The system information D3 includes an item of current date and time. The current date and time is information of the current time, which is output by the clock of the system.

The service lifetime management information D4 includes member IDs, member service lifetimes, cumulative used service lifetimes and so forth for the respective members of the image forming apparatus 1; and operating finish date and time, a reference ambient temperature, an assumed worst ambient temperature, a group of coefficients, an ambient temperature obtaining table T1, an at-reference-ambient-temperature member temperature obtaining table T2 and a member temperature coefficient obtaining table T3, which are common for the image forming apparatus 1. The member ID is information used for identifying each member included in the image forming apparatus 1. The member service lifetime is a value of a service lifetime for which the member can be used or operated. The cumulative used service lifetime is a value of a service lifetime resulting from being consumed due to usage or operation of the member. It is noted that instead of calculating and storing the cumulative used service lifetime each time the member is used or operated, combinations of the temperatures and the operating periods of time at the temperatures may be stored, and after that, the cumulative used service lifetime may be calculated as it is needed. The operating finish date and time are date and time at which usage or operation of the unit 11 has most recently finished. The reference ambient temperature is an ambient temperature used as a condition for the at-reference-ambient-temperature member temperature obtaining table T2 described later. The assumed worst ambient temperature is an ambient temperature used as a default value in a case where the ambient temperature cannot be obtained in processes described later. The group of coefficients are coefficients used for various numerical formulas.

Figure 3:
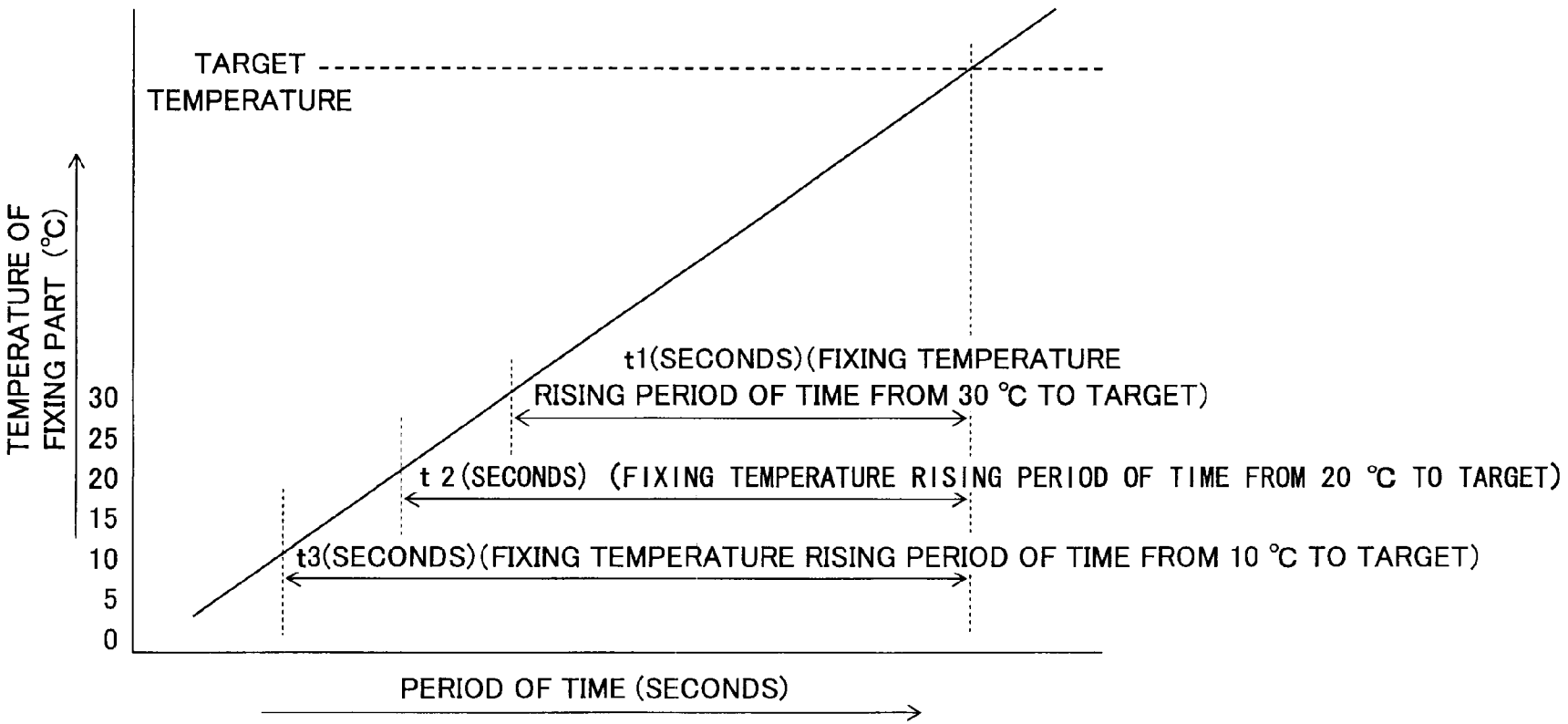
FIG. 3 shows a relationship between a fixing temperature rising period of time and an ambient temperature.

The ambient temperature obtaining table T1 holds a fixing temperature rising period of time required until a certain fixing temperature (target temperature) is reached and an ambient temperature predicted in this case, in a manner of being associated with one another. FIG. 3 shows a relationship between the fixing temperature rising period of time and the ambient temperature. As shown, the fixing temperature rising period of time required from when the power supply to the heater is started until when the target temperature is reached becomes shorter as the ambient temperature is higher. In contrast thereto, the fixing temperature rising period of time becomes longer as the ambient temperature is lower. Thus, a certain relationship exists between the fixing temperature rising period of time and the ambient temperature. Therefore, it is possible to obtain (predict) the ambient temperature from the fixing temperature rising period of time, by previously obtaining the relationship between the fixing temperature rising period of time and the ambient temperature through an experiment or such and holding the obtained relationship in the ambient temperature obtaining table T1.

It is noted that in the ambient temperature obtaining table T1, the fixing temperature rising period of time is graduated in units of two seconds as shown in FIG. 2. However, graduating the fixing temperature rising period of time is not limited thereto. The fixing temperature rising period of time may be graduated in units of one second, or in units of 0.1 seconds, for example. In a case of obtaining a value at a position between the adjacent graduations, it is possible to carry out linear interpolation. Further, instead of using the form of a table, it is possible to express the relationship between the fixing temperature rising period of time and the ambient temperature by a numerical formula. Assuming that the ambient temperature is denoted by T [° C.], the fixing temperature rising period of time is denoted by t [seconds], and A and a denote constants, it is possible to use the numeral formula:

$$T=A-a\times t$$

In the case of the values in the ambient temperature obtaining table T1 of FIG. 2, it is possible to obtain the relationship of:

$$T=150-5\times t$$

Further, the fixing temperature rising period of time is influenced by the temperature of the fixing part 13 at a time when the temperature rising is started. Therefore, in order to obtain the ambient temperature precisely, it is necessary that the temperature of the fixing part at a time when the temperature rising is started corresponds to the ambient temperature. In order to obtain the condition where the temperature of the fixing part at a time when the temperature rising is started corresponds to the ambient temperature, it is necessary that a certain period of time or more (ordinarily, on the order of one hour or more) has elapsed from when the power supply to the fixing part 13 is turned off. Therefore, a method may be used to make it a proviso that the certain period of time or more has elapsed in the sleep mode (i.e., a power saving mode where the power supply to parts used for waiting for a signal to come is turned off) adopted in many image forming apparatuses of an electrophotographic type.

Further, the fixing temperature rising period of time is influenced by the resistance value of the heater or the input voltage to the heater. As to the resistance value of the heater, the following method may be used for correction. That is, the resistance value of the heater is measured when the image forming apparatus 1 is shipped. Then, a multiplier for correction corresponding to the measured resistance value is stored the control part 14. Alternatively, possible resistance values of the heater and candidates for a multiplier for correction corresponding to the respective ones of the possible resistance values of the heater are stored in the control part 14. Then, the obtained ambient temperature is multiplied by the corresponding multiplier, or the member temperature obtained from the at-reference-ambient-temperature member temperature obtaining table T2 described below is multiplied by the multiplier. As to the input voltage, the following method may be used for correction. That is, candidates for a multiplier for correction corresponding to the respective ones of possible input voltage values are stored in the control part 14. Then, the input voltage value is measured at a time of operating, and the obtained ambient temperature is multiplied by the corresponding multiplier, or the member temperature obtained from the at-reference-ambient-temperature member temperature obtaining table T2 described below is multiplied by the multiplier.

In the at-reference-ambient-temperature member temperature obtaining table T2, as shown FIG. 4, the member temperatures at the reference ambient temperature are held for the respective members for the respective statuses (operating states) of the image forming apparatus 1. The member temperature of each member in the inside of the image forming apparatus 1 depends upon the nature of the member, the disposition of the member, the ambient temperature, the operating state and so forth, and has a certain temperature distribution. Therefore, by fixing the ambient temperature to be a certain reference ambient temperature, the member temperature of each member is determined by the operating state. The actual member temperature of each member is obtained from adding the difference of the ambient temperature from the reference ambient temperature ("ambient temperature"–"reference ambient temperature") to the member temperature at the reference ambient temperature. Thus, the correction is carried out using the ambient temperature for the difference in the member temperature caused by the ambient temperature. Therefore, in comparison to a case where the correction is carried out using the temperature at the inside of the apparatus, it is possible to carry out the correction easily and precisely.

Further, instead of using the at-reference-ambient-temperature member temperature obtaining table T2, it is possible to calculate the member temperature at the reference ambient temperature by the following method. That is, for each member, thermal resistance information indicating a degree of how easily heat is propagated from each of a heat source and a part having the reference ambient temperature to the member is previously stored. Further, temperature information (information indicating the temperature which the heat source becomes to have) at the reference ambient temperature for each status (operating state) of the image forming apparatus 1 is previously stored. Thereby, it is possible to calculate the member temperature at the reference ambient temperature. The actual member temperature of each member can be obtained from adding the difference of the ambient temperature from the reference ambient temperature ("ambient temperature"–"reference ambient temperature") to the member temperature at the reference ambient temperature.

In the member temperature coefficient obtaining table T3, as shown in FIG. 5, the member temperatures and the temperature coefficients are held in a manner of being associated with each other for the respective members. The temperature coefficients indicate degrees of influence of the member temperatures on the service lifetimes of the members, respectively. As described later, the temperature coefficients are used to calculate the cumulative used service lifetimes.

It is noted that in the member temperature coefficient obtaining table T3, the member temperature is graduated in units of 5° C. However, the graduations of the member temperature are not limited thereto, and instead, the member temperature may be graduated in units of 1° C., or in units of 0.1° C., for example. In a case of obtaining a value at a position between the adjacent graduations, it is possible to carry out linear interpolation. Further, instead of using the form of a table, it is possible to express the relationship between the member temperature and the temperature coefficient by a numerical formula.

Returning to FIG. 1, the display part 17 is a display part such as a liquid crystal panel provided on an operating console (not shown) of the image forming apparatus 1. In the embodiment of the present invention, especially, it is possible to display, to the user of the image forming apparatus 1, limits of usable periods of time (values obtained from subtracting the cumulative used service lifetimes from the member service lifetimes, respectively) for the respective members.

The communication interface part 18 is a part configured to carry out data communication with an external apparatus via a communication network such as a LAN (Local Area Network). In the embodiment of the present invention, especially, it is possible to transmit, to an external apparatus, information such as the limits of usable periods of time, the member service lifetimes and the cumulative used service lifetimes for the respective members. Thus, it is possible to obtain, from the external apparatus, the limits of usable periods of time for the respective members (directly or by calculation made by itself).

The external recording medium interface part 19 is a part configured to carry out data input and output with a portable memory device 2 such as a flash memory. In the embodiment of the present invention, especially, it is possible to output, to the portable memory device 2, information such as limits of usable periods of times, the member service lifetimes and the cumulative used service lifetimes for the respective members. Thus, by reading the information from the portable memory device 2, it is possible to obtain the limits of usable periods of time for the respective members (directly obtained or obtained by calculating by itself).

In FIG. 1, the one/plural units 11 that can be easily replaced is/are shown. However, there may be a case where no unit 11 exists in the image forming apparatus 1. Further, with reference to FIG. 1 the case has been described where the member IDs, member service lifetimes and, cumulative used service lifetimes and so forth for the respective members and the operating finish date and time common to the image forming apparatus 1 are included in the service lifetime management information D4 in the storage part 16 of the control part 14. However, in a case where only the unit information D1 in the storage part 12 of the unit 11 is used, the member IDs, member service lifetimes, cumulative used service lifetimes and so forth for the respective members and the operating finish date and time are not necessary.

Figure 6:
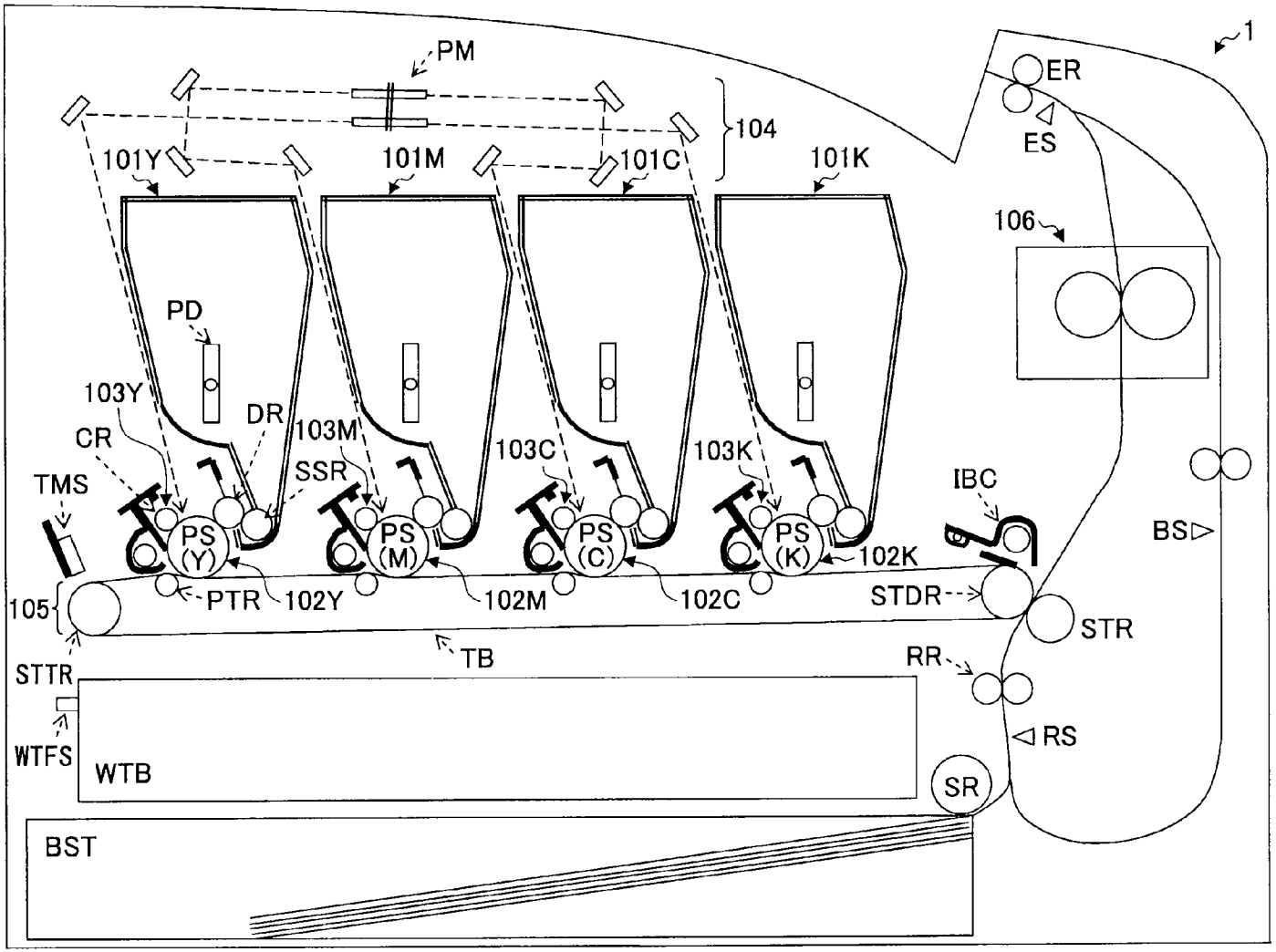
FIG. 6 shows one example of a mechanical configuration of the image forming apparatus.

FIG. 6 shows an example of a mechanical configuration of the image forming apparatus 1, and shows a sectional view of a full-color image forming apparatus called a tandem machine.

As shown in FIG. 6, the image forming apparatus 1 has four development parts 101K, 101C, 101M and 101Y for black (K), cyan (C), magenta (M) and yellow (Y), which are black and three primary colors, photosensitive members 102K, 102C, 102M and 102Y (PS(K), PS(C), PS(M) and PS(Y)), electrification parts 103K, 103C, 103M and 103Y, an exposure part 104, a transfer part 105 and a fixing part 106. Thereby, it is possible to form an image on a sheet of paper as a recording medium. For example, the development part 101K, the photosensitive member 102K, the electrification part 103K and so forth, correspond to the unit 11 (see FIG. 1) that is easily replaced as an all-in-one-type cartridge. Further, the fixing part 106 corresponds to the fixing part 13 of FIG. 1.

Further, the exposure unit 104 includes a polygon mirror PM. Each of the development parts 101K, 101C, 101M and 101Y includes a paddle PD, a development roller DR and a supply roller SSR. Each of the electrification parts 103K, 103C, 103M and 103Y includes an electrification roller CR. The transfer part 105 includes an intermediate transfer belt TB, four primary transfer rollers PTR, a secondary transfer driving roller STDR, a secondary transfer roller STR, a secondary tension roller STTR, a TM (Toner Mark) sensor TMS and an intermediate transfer belt cleaner IBC. The image forming apparatus 1 further includes a body paper supply tray BST, a paper supply roller SR, a registration sensor RS, registration rollers RR, a duplex sensor BS (used when duplex printing is carried out), a paper ejection sensor ES, paper ejection rollers ER, a waste toner detection sensor WTFS and a waste toner box WTB.

<Operations>

First, mechanical operations of the image forming apparatus 1 will be described.

In FIG. 6, an image is formed on a sheet of paper by the following procedure. First, electrification is carried out on the photosensitive members 102K, 102C, 102M and 102Y by the electrification parts 103K, 103C, 103M and 103Y, respectively. Next, the exposure part 104 drives a LD (Laser Diode, not shown) according to image data included in given printing instructions, and laser light is used to irradiate the polygon mirror PM. Then, via the polygon mirror PM and other mirrors, irradiation directions of the laser light are controlled, and electrostatic latent images for the respective colors, i.e., K, C, M and Y, are formed on the photosensitive members 102K, 102C, 102M and 102Y, respectively. Then, the electrostatic latent images on the photosensitive members 102K, 102C, 102M and 102Y are developed by the development parts 101K, 101C, 101M and 101Y, respectively, using corresponding inks of K, C, M and Y. Then, in the transfer part 105, the thus-obtained toner images are transferred and superposed on the intermediate transfer belt TB (i.e., a transfer member) in sequence by the primary transfer rollers PTR. Then, the superposed toner image (developed image) is transferred by the secondary transfer driving roller STDR and the secondary transfer roller STR to a sheet of paper, supplied from the body paper supply tray BST by the supply roller SR and the registration rollers RR. The toner image thus transferred onto the sheet of paper is then heated and fixed by the fixing part 106, and the sheet of paper on which the toner image is thus fixed is conveyed and ejected by the ejection rollers ER. Thus, the full-color image can be formed on the sheet of paper.

FIG. 7 is a flowchart showing an example of processes for a case where the unit information D1 in the unit 11 is used.

In FIG. 7, when the power supply in the image forming apparatus 1 is turned on (ON), the processes are started (step S101). Then, the control processing part 15 of the control part 14 obtains the unit information D1 from the storage part 12 of the unit 11 (step S102).

Next, the control processing part 15 determines whether currently the unit 11 is being used for the first time, by determining whether the operating finish date and time or the cumulative used service lifetime of the unit information D1 is null (step S103).

In a case where it is determined that currently the unit 11 is being used for the first time (step S103 YES), the control processing part 15 subtracts the production date and time (production year, month and date) of the unit information D1 from the current date and time of the system information D3, and calculates a preceding elapsed period of time. Then, by the following formula, a preceding degradation degree is calculated (step S104):

$$\text{preceding degradation degree} = \text{preceding elapsed period of time} \times \text{corresponding degradation coefficient}$$

The corresponding degradation coefficient is a coefficient to be used for converting the preceding elapsed period time into the preceding degradation degree, and is obtained from the group of coefficients of the service lifetime management information D4.

Next, the control processing part 15 writes the calculated preceding degradation degree in the cumulative used service lifetime for each member of the unit information D1 in the storage part 12 of the unit 11 (step S105).

On the other hand, in a case where currently the unit 11 is being used not for the first time (step S103 NO), the control processing part 15 calculates a not-operated elapsed period of time by subtracting the operating finish date and time of the unit information D1 from the current date and time of the system information D3, and calculates the cumulative used service lifetime for each member by the following formula (step S106):

$$\text{cumulative used service lifetime} = \text{not-operated elapsed period of time} \times \text{corresponding degradation coefficient} + \text{cumulative used service lifetime}$$

The corresponding degradation coefficient is a coefficient to be used for converting the not-operated elapsed period of time into a corresponding degradation degree, and is obtained from the group of coefficients of the service lifetime management information D4.

Next, the control processing part 15 writes the calculated cumulative used service lifetimes for the respective members in the cumulative used service lifetimes for the respective members of the unit information D1 in the storage part 12 of the unit 11 (step S107).

After the processes for the corresponding one of the case "for the first time" and the case "not for the first time", the control processing part 15 calculates the limits of usable periods of time for the respective members by subtracting the cumulative used service lifetimes from the member service lifetimes for the respective members in the unit information D1, and determines whether each of the calculated limits of usable periods of time is equal to or less than a certain threshold (step S108).

In a case where any of the limits of usable periods of time is equal to or less than the certain threshold (step S108 YES), an alarm is generated to alert the user of the image forming apparatus 1 (step S109). The alarm includes, for example, displaying the limit of usable period of time in a manner of being associated with the member on the display part 17, blinking a printing possible lamp (not shown, a lamp which is turned on when data waiting to be printed exists) on the operating console, or so. By this alarm, the user can know that the service lifetime of the unit 11 has run short or the service lifetime of the member included in the inside of the unit 11 has run short. Thus the user can take necessary measures to replace the unit 11 or so without delay. Further, it is possible to avoid replacing the member until the service lifetime actually has run short.

After the alarm is thus generated (step S109) or in a case where it is determined that each of the limits of usable periods of time is neither equal to nor less than the certain threshold (step S108 NO), the control processing part 15 then determines whether to finish operation of the image forming apparatus 1 (step S110). The control processing part 15 determines in step S110 to finish operation of the image forming apparatus 1 as a result of the user carrying out the corresponding operation on the operating console of the image forming apparatus 1, an interruption of the power supply to the image forming apparatus 1 occurring, or so. It is noted that even when a sudden interruption of the power supply to the image forming apparatus 1 occurs, the control processing part 15 can continue the processes for a limited short period of time using backup power supply (not shown).

In a case where the control processing part 15 has determined not to finish operation of the image forming apparatus 1 (step S110 NO), the control processing part 15 determines from "whether printing instruction is given" of the operating information D2 whether a printing instruction has been given (step S111), and waits for a printing instruction to be given in a case where no printing instruction has been given (step S111 NO).

In a case where it is determined that a printing instruction has been given (step S111 YES), the control processing part 15 calculates the temperature coefficient for each member for which the service lifetime is to be managed (step S112). Details of calculating the temperature coefficient for each member will be described later.

Next, the control processing part 15 obtains the operating information D2 (of the present time) from the storage part 16 (step S113), and calculates the cumulative used service lifetime by the following formula (step S114):

$$\begin{aligned}\text{cumulative used service lifetime} = {} & \text{printing period of time} \times \text{corresponding} \\ & \text{degradation coefficient} \times \text{temperature coefficient} + \\ & \text{waiting period of time} \times \text{corresponding degradation coefficient} \times \\ & \text{temperature coefficient} + \text{sleep period of time} \times \text{corresponding} \\ & \text{degradation coefficient} \times \text{temperature coefficient} + \\ & \text{printing number of sheets} \times \text{corresponding degradation coefficient} \times \\ & \text{temperature coefficient} + \text{cumulative used service lifetime}\end{aligned}$$

The corresponding degradation coefficients are coefficients to be used for converting the printing period of time, the waiting period of time, the sleep period of time and the printing number of sheets into corresponding degradation degrees, respectively, and are obtained from the group of coefficients of the service lifetime management information D4.

Next, the control processing part 15 writes the calculated cumulative used service lifetime in the cumulative used service lifetime for each member of the unit information D1 in the storage part 12 of the unit 11 (step S115). Then, the processes are returned to the determination as to whether any of the limits of usable periods of time is equal to or less than the certain threshold (step S108).

On the other hand, in a case where the control processing part 15 has determined to finish operation of the image forming apparatus 1 (step S110 YES), the control processing part 15 writes the current date and time of the system information D3 in the operating finish date and time of the unit information D1 of the storage part 12 of the unit 11 (step S116), turns off (OFF) the power supply in the image forming apparatus 1, and finishes the processes (step S117).

It is noted that although not shown in the flowchart of FIG. 7, it is also possible to transmit the calculated cumulative used service lifetimes or limits of usable periods of time to another apparatus via the communication interface part 18 and the communication network or output the calculated cumulative used service lifetimes or limits of usable periods of time to the potable memory device 2 via the external recording medium interface part 19. Further, it is possible to directly read data from the storage part 12 of the unit 11 to the external portable memory device 2 without passing it through the control part 14.

Figure 8:
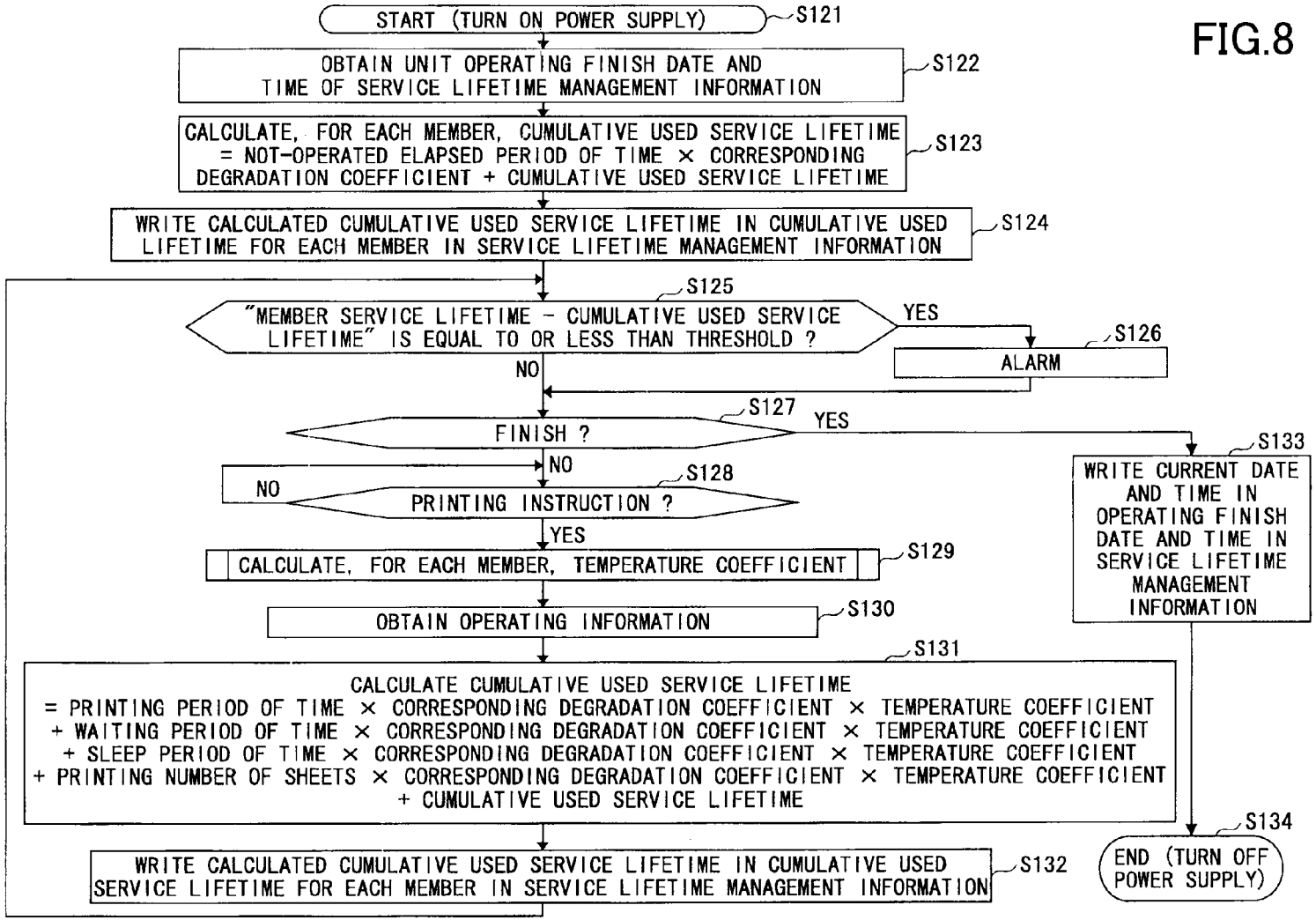
FIG. 8 shows a flowchart of one example of processes for a case where the unit information is not used.

FIG. 8 is a flowchart for a case where the unit information D1 of the unit 11 is not used.

In FIG. 8, when the power supply in the image forming apparatus 1 is turned on (ON), the processes are started (step S121). Then, the control processing part 15 of the control part 14 obtains the operating finish date and time of the service lifetime management information D4 from the storage part 16 (step S122).

Next, the control processing part 15 calculates the not-operated elapsed period of time by subtracting the operating finish date and time of the service lifetime management information D4 from the current date and time of the system information D3, and calculates the cumulative used service lifetime for each member by the following formula (step S123):

$$\begin{aligned}\text{cumulative used service lifetime} = {} & \text{not-operated elapsed period of time} \times \text{corresponding} \\ & \text{degradation coefficient} + \text{cumulative used service lifetime}\end{aligned}$$

The corresponding degradation coefficient is a coefficient to be used for converting the not-operated elapsed period of time into a corresponding degradation degree, and is obtained from the group of coefficients of the service lifetime management information D4.

Next, the control processing part 15 writes the calculated cumulative used service lifetimes in the cumulative used service lifetime for the respective members in the service lifetime management information D4 of the storage part 16 (step S124).

After that, the control processing part 15 calculates the limits of usable periods of time for the respective members by subtracting the cumulative used service lifetimes from the member service lifetimes of the service lifetime management information D4, respectively, and determining whether each of the calculated limits of usable periods of time is equal to or less than a certain threshold (step S125).

In a case where any of the limits of usable periods of time is equal to or less than the certain threshold (step S125 YES), an alarm is generated to alert the user of the image forming apparatus 1 (step S126). The alarm includes, for example, displaying the limit of usable period of time in a manner of being associated with the member on the display part 17, blinking the printing possible lamp on the operating console, or so. By this alarm, the user can know that the service lifetime of the specific member has run short. Thus the user can take necessary measures to replace the member or so without delay. Further, it is possible to avoid replacing the member until the service lifetime has actually run short.

After the alarm is thus generated (step S126) or in a case where it is determined that each of the limits of usable periods of time is neither equal to nor less than the certain threshold (step S125 NO), the control processing part 15 determines whether to finish operation of the image forming apparatus 1 (step S127). The control processing part 15 determines in step S110 to finish operation of the image forming apparatus 1 as a result of the user carrying out the corresponding operation on the operating console of the image forming apparatus 1, an interruption of the power supply to the image forming apparatus 1 occurring, or so. It is noted that even when a sudden interruption of the power supply to the image forming apparatus 1 occurs, the control processing part 15 can continue the processes for a limited short period of time using the backup power supply.

In a case where the control processing part 15 has determined not to finish operation the image forming apparatus 1 (step S127 NO), the control processing part 15 then determines from "whether printing instruction is given" of the operating information D2 whether a printing instruction has been given (step S128), and waits for a printing instruction to be given in a case where no printing instruction has been given (step S128 NO).

In a case where it is determined that a printing instruction has been given (step S128 YES), the control processing part 15 calculates the temperature coefficient for each member for which the service lifetime is to be managed (step S129). Details of calculating the temperature coefficient for each member will be described later.

Next, the control processing part 15 obtains the operating information D2 (of the present time) from the storage part 16 (step S130), and calculates the cumulative used service lifetime by the following formula (step S131):

cumulative used service lifetime = printing period of time × corresponding degradation coefficient × temperature coefficient + waiting period of time × corresponding degradation coefficient × temperature coefficient + sleep period of time × corresponding degradation coefficient × temperature coefficient + printing number of sheets × corresponding degradation coefficient × temperature coefficient + cumulative used service lifetime The corresponding degradation coefficients are coefficients to be used for converting the printing period of time, the waiting period of time, the sleep period of time and the printing number of sheets into corresponding degradation degrees, respectively, and are obtained from the group of coefficients of the service lifetime management information D4.

Next, the control processing part 15 writes the calculated cumulative used service lifetime in the cumulative used service lifetime for each member of the service lifetime management information D4 of the storage part 16 (step S132). Then, the processes are returned to the determination as to whether each of the limits of usable periods of time is equal to or less than the certain threshold (step S125).

On the other hand, in a case where the control processing part 15 has determined to finish operation of the image forming apparatus 1 (step S127 YES), the control processing part 15 writes the current date and time of the system information D3 into the operating finish date and time of the service lifetime management information D4 of the storage part 16 (step S133), turns off (OFF) the power supply in the image forming apparatus 1, and finishes the processes (step S134).

It is noted that although not shown in the flowchart of FIG. 8, it is also possible to transmit the calculated cumulative used service lifetimes or limits of usable periods of time to another apparatus via the communication interface 18 and the communication network or output the calculated cumulative used service lifetimes or limits of usable periods of time to the potable memory device 2 via the external recording medium interface part 19. Further, it is possible to directly read data from the storage part 16 to the external portable memory device 2 without passing it through the control part 14.

Further, the processes for the case where the unit information D1 of the unit 11 is used (FIG. 7) and the processes for the case where the unit information D1 of the unit 11 not is used (FIG. 8) have been described above separately. However, in a case where no unit 11 exists in the image forming apparatus 1, only the processes for the case where the unit information D1 of the unit 11 is not used (FIG. 8) are carried out. In a case where the unit(s) 11 exists(exist) in the image forming apparatus 1, the processes for the case where the unit information D1 of the unit 11 is used (FIG. 7) or the processes for the case where the unit information D1 of the unit 11 not is used (FIG. 8) may be carried out. Further, in the case where the unit(s) 11 exists(exist) in the image forming apparatus 1, both the processes for the case where the unit information D1 of the unit 11 is used (FIG. 7) and the processes for the case where the unit information D1 of the unit 11 not is used (FIG. 8) may be carried out.

Figure 9:
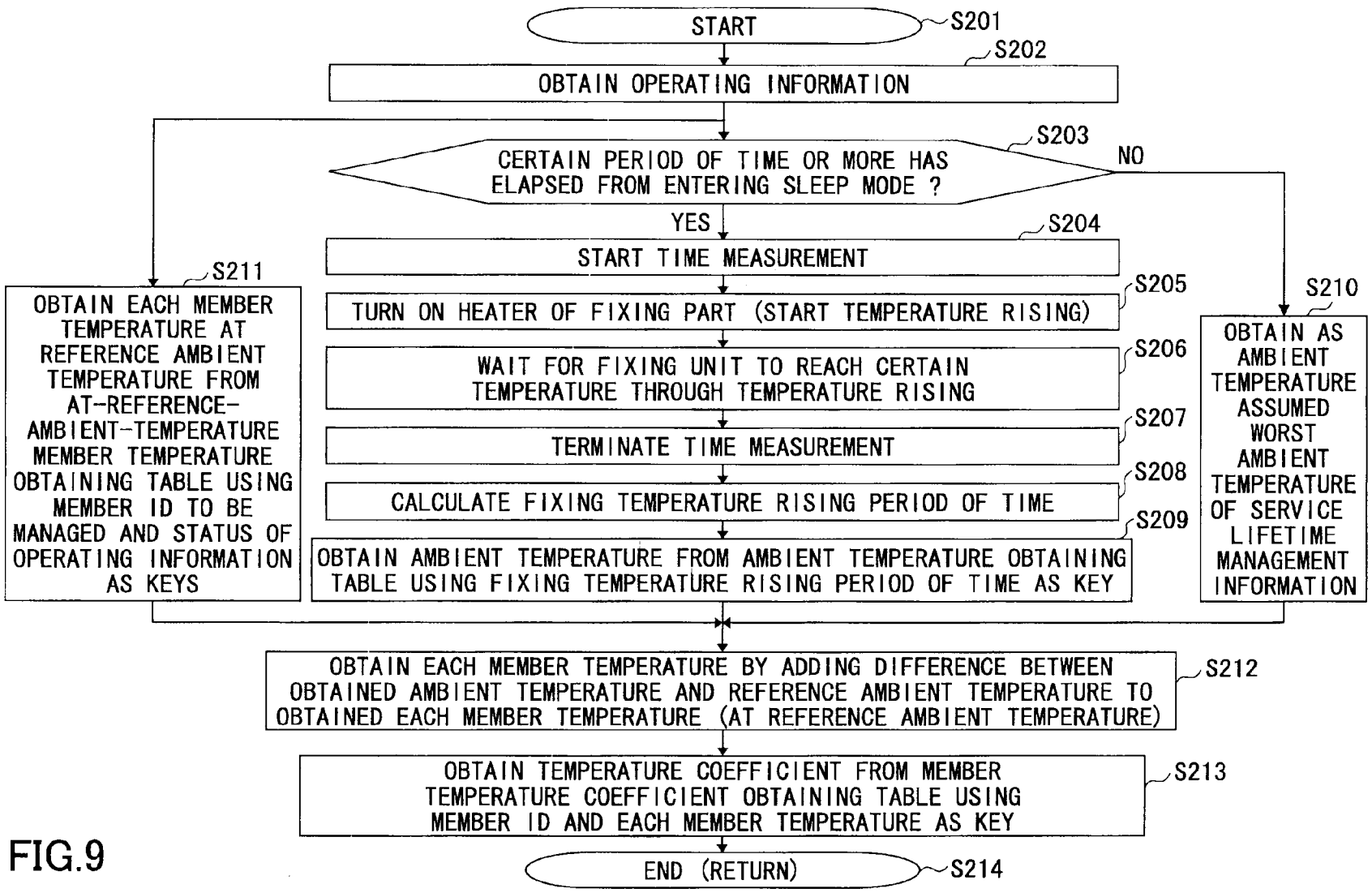
FIG. 9 shows a flowchart of one example of processes for calculating a temperature coefficient for each member.

FIG. 9 is a flowchart showing one example of calculating the temperature coefficient for each member (corresponding to each of step S112 of FIG. 7 and step S129 of FIG. 8).

In FIG. 9, when the processes are started (step S201), the control processing part 15 obtains the operating information D2 from the storage part 16 (step S202).

Next, the control processing part 15 determines whether a certain period of time or more (for example, 1 hour or more) has elapsed from when the image forming apparatus 1 has entered the sleep mode, by determining whether the status of the operating information D2 is "on sleep" and also whether the value of the "sleep period of time" is equal to or more than a certain value (step S203).

In a case where it is determined that the certain period of time or more has elapsed from when the image forming apparatus 1 has entered the sleep mode (steep S203 YES), the control processing part 15 starts a measurement of a period of time by obtaining the current date and time of the system information D3 (step S204).

Next, the control processing part 15 turns on the power supply to the heater of the fixing part 13, and starts raising the temperature of the fixing part 13 (steep S205).

Next, the control processing part 15 waits for the temperature of the fixing part 13 to rise to a certain temperature (step S206). The fixing part 13 controls turning on and off of the power supply to the heater so that the fixing part 13 comes to have the target temperature using a temperature sensor (not shown) in the inside of the fixing part 13. The control processing part 15 can determine such a state of the fixing part 13 as to whether the fixing part 13 has reached the target temperature.

Next, when the temperature of the fixing part 13 has risen to the certain temperature, the control processing part 15 terminates the measurement of period of time by obtaining the current date and time of the system information D3 (step S207).

Next, the control processing part 15 calculates the fixing temperature rising period of time by subtracting the current date and time obtained when the measurement of period of time has been started from the current date and time obtained when the measurement of period of time has been terminated (step S208).

Next, the control processing part 15 obtains the ambient temperature from the ambient temperature obtaining table T1 using the calculated fixing temperature rising period of time as a key (step S209).

Further, in a case where it is determined that the certain period of time or more has not elapsed from when the image forming apparatus 1 has entered the sleep mode (steep S203 NO), the control processing part 15 cannot predict (obtain) the ambient temperature from the fixing temperature rising period of time. Therefore, the control processing part 15 obtains the assumed worst ambient temperature of the service lifetime management information D4 as the ambient temperature (step S210).

On the other hand, in parallel to the above-mentioned processes, the control processing part 15 obtains the respective member temperatures at the reference ambient temperature from the at-reference-ambient-temperature member temperature obtaining table T2 using the member IDs to be managed and the status of the operating information D2 as keys (step S211).

After that, the control processing part 15 adds, to each of the thus-obtained respective member temperatures (at the reference ambient temperature), the difference of the thus-obtained ambient temperature (i.e., the ambient temperature predicted (obtained) from the fixing temperature rising period of time or the assumed worst ambient temperature set (obtained) as the ambient temperature) from the reference ambient temperature, and thus obtains the respective member temperatures by (step S212).

Next, the control processing part 15 obtains the temperature coefficients for the respective members from the member temperature coefficient obtaining table T3 using the member IDs and the respective member temperatures as keys (step S213), and finishes the processes (step S214).

Summary of Embodiment

As described above, according to the embodiment of the present invention, the following advantages are obtained.

(1) The temperature in the inside of the apparatus (i.e., near the target member) is predicted from the fixing temperature rising period of time, the degradation degree is determined based on the thus-obtained temperature information, and the determined degradation degree is reflected in the service lifetime calculation. Thereby, a part only for measuring the temperature is not needed, the member for which the temperature is to be obtained is not limited, and the service lifetime calculation can be carried out considering the actual operating environment. As a result of the actual remaining service lifetime being thus clearly obtained, it is possible to use the member until the end of the actual limit of usable period of time of the member. Thus, it is possible to reduce the frequency of replacing the member, and thus, it is possible to contribute to Reduction. Further, the remaining service lifetime of the unit can be clearly obtained at a time when operation or usage of the target apparatus is finished, and thus, it is possible to contribute to Reuse.

(2) Because the remaining service lifetime is displayed on the target apparatus, it is possible to use the member until the end of the actual limit of usable period of time of the member. Thus, it is possible to reduce the frequency of replacing the member, and thus, it is possible to contribute to Reduction.

(3) Because the remaining service lifetime can be indicated by turning on (lighting) a lamp (LED or such) on the target apparatus, it is possible to carry out reporting simply and easily. The same effect can be obtained also from blinking the lamp. Thus, it is also possible to distinguish between "expiration of the limit of usable period of time is approaching" and "the limit of usable period of time has been already exceeded" or such by distinguishing between carrying out turning on the lamp and blinking the lamp.

(4) Because the information of the remaining service lifetime can be output to the outside of the target apparatus, it is possible to obtain the information of the remaining service lifetime from a personal computer or such used as a printer driver. Therefore, it is possible to use the member until the end of the actual limit of usable period of time. Thus, it is possible to reduce the frequency of replacing the member, and thus, it is possible to contribute to Reduction. Further, because it is possible to obtain the information of the remaining service lifetime of the unit at a time when operation or usage of the target apparatus is finished, by connecting the personal computer or such, it is possible to contribute to Reuse.

(5) Because the information of the remaining service lifetime can be taken out from the apparatus in a state where the information is stored in a non-volatile memory, it is possible to obtain the information of the remaining service lifetime without turning on the power supply in the image forming apparatus 1. Therefore, it is possible to determine to reuse the member even at a place where there is no environment of operating the apparatus.

The present invention is not limited to the specifically disclosed embodiments, and variations and modifications may be made without departing from the scope of the present invention.

The present application is based on Japanese Priority Patent Application No. 2010-208205, filed Sep. 16, 2010, the entire contents of which are hereby incorporated herein by reference.

What is claimed is:

1. An image forming apparatus having a fixing part that fixes a toner image onto a recording medium by heating it, comprising:

an ambient temperature predicting part configured to predict an ambient temperature from a fixing temperature rising period of time that is a period of time taken until the fixing part reaches a certain temperature;

a member temperature predicting part configured to predict a member temperature of a member from the predicted ambient temperature and an operating state of the image forming apparatus;

a cumulative-used-service-lifetime calculating part configured to calculate a current cumulative used service lifetime from the predicted member temperature, the operating state of the image forming apparatus and an immediately preceding cumulative used service lifetime of the member;

a remaining lifetime calculating part configured to calculate a remaining lifetime by subtracting the calculated current cumulative used service lifetime from a service lifetime of the member; and a reporting part configured to report the remaining lifetime.

2. The image forming apparatus as claimed in claim 1, wherein the ambient temperature obtaining part is configured to measure the fixing temperature rising period of time taken until the fixing part reaches the certain temperature, and obtain the ambient temperature based on the measured fixing temperature rising period of time by reading a table holding the fixing temperature rising periods of time and the ambient temperatures in a manner of respectively being associated with each other.

3. The image forming apparatus as claimed in claim 1, wherein the ambient temperature obtaining part is configured to measure the fixing temperature rising period of time taken until the fixing part reaches the certain temperature, and obtain the ambient temperature based on the measured fixing temperature rising period of time by using a numerical formula indicating a relationship between the fixing temperature rising period of time and the ambient temperatures.

4. The image forming apparatus as claimed in claim 1, wherein the member temperature predicting part is configured to read a table holding the member temperatures of the respective members at the reference ambient temperature for each of the operating states of the image forming apparatus to obtain the member temperature at the reference ambient temperature for each of the operating states, and obtain the actual member temperature by adding the difference between the predicted ambient temperature and the reference ambient temperature to the obtained member temperature.

5. The image forming apparatus as claimed in claim 1, wherein the member temperature predicting part is configured to calculate the member temperature at the reference ambient temperature by using thermal resistance information indicating, for each member, a degree of how easily heat is propagated from respective ones of a heat source and a part having the reference ambient temperature to the member and temperature information of the heat source at the reference ambient temperature for each of operating states of the image forming apparatus, and obtain the actual member temperature by adding the difference between the predicted ambient temperature and the reference ambient temperature to the calculated member temperature.

6. The image forming apparatus as claimed in claim 1, wherein the cumulative-used-service-lifetime calculating part is configured to obtain, based on the obtained member temperature, the temperature coefficient by reading a third table holding for each member the member temperatures and the temperature coefficients in a manner of being respectively associated with one another, and calculate the cumulative used service lifetime by using time periods of respective operating states of the image forming apparatus and the temperature coefficient.

7. The image forming apparatus as claimed in claim 1, wherein the cumulative-used-service-lifetime calculating part is configured to obtain, based on the obtained member temperature, the temperature coefficient from a numerical formula indicating a relationship between the member temperature and the temperature coefficient, and calculate the cumulative used service lifetime by using time periods of respective operating states of the image forming apparatus and the temperature coefficient.

8. The image forming apparatus as claimed in claim 1, wherein the reporting part is configured to display the remaining lifetime on a display part of the image forming apparatus.

9. The image forming apparatus as claimed in claim 1, wherein the reporting part is configured to change an indication by a lamp of the image forming apparatus in a case where the remaining lifetime becomes shorter than a certain period of time.

10. The image forming apparatus as claimed in claim 1, further comprising:

a part configured to output as data the remaining lifetime or the cumulative used service lifetime.

11. An image forming control method of controlling an image forming apparatus having a fixing part that fixes a toner image onto a recording medium by heating it, comprising:

predicting an ambient temperature from a fixing temperature rising period of time that is a period of time taken until the fixing part reaches a certain temperature;

predicting a member temperature of a member from the predicted ambient temperature and an operating state of the image forming apparatus;

calculating a current cumulative used service lifetime from the predicted member temperature, the operating state of the image forming apparatus and an immediately preceding cumulative used service lifetime of the member;

calculating a remaining lifetime by subtracting the calculated current cumulative used service lifetime from a service lifetime of the member; and reporting the calculated remaining lifetime.

* * * * *